US006198891B1

(12) United States Patent
Ishida et al.

(10) Patent No.: US 6,198,891 B1
(45) Date of Patent: Mar. 6, 2001

(54) IMAGE FORMING APPARATUS

(75) Inventors: Hideki Ishida; Toshiaki Kusuda; Sueaki Okamoto; Kazuya Kamidaira; Tadakazu Ohgiri, all of Osaka; Kiyoaki Miyamoto, Nara; Kuniaki Nakano, Osaka, all of (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/320,452

(22) Filed: May 27, 1999

(30) Foreign Application Priority Data

Jun. 3, 1998 (JP) ..... 10-154940

(51) Int. Cl.[7] ..... G03G 21/16; G03G 15/00
(52) U.S. Cl. ..... 399/117; 399/113; 399/116
(58) Field of Search ..... 399/117, 113, 399/116, 159, 167, 299, 306

(56) References Cited

U.S. PATENT DOCUMENTS 4,866,482 * 9/1989 Hirasawa et al. ..... 355/260
5,303,018 * 4/1994 Terada et al. ..... 355/326 R
5,745,825 * 4/1998 Okawa et al. ..... 399/117

* cited by examiner

*Primary Examiner*—Richard Moses
(74) *Attorney, Agent, or Firm*—Smith, Gambrell & Russell, LLP

(57) ABSTRACT

An image forming apparatus having: a plurality of photoreceptors provided along a sheet transportation path and each extending perpendicularly to the sheet transportation path; and an imaging mechanism for forming toner images on surfaces of the respective photoreceptors. A pair of support plates receive opposite end circumferential portions of the respective photoreceptors to support the photoreceptors together in a parallel relation. Bearings are fitted around the opposite end circumferential portions of the respective photoreceptors, and the pair of support plates each have the same number of cut-away portions as the number of the photoreceptors for receiving outer rings of the bearings, the cut-away portions being formed in a spaced apart relation.

10 Claims, 6 Drawing Sheets

IMAGE FORMING APPARATUS

BACKGROUND OF THE INVENTION

1. Field of the Invention

The present invention relates to an image forming apparatus of tandem type which includes a plurality of photoreceptors disposed along a linearly extending sheet transportation path.

2. Description of Related Art

In recent years, color image forming apparatuses of tandem type have been provided in which four photoreceptor drums respectively adapted to form cyan, magenta, yellow and black monochromatic toner images are disposed in series along a linearly extending sheet transportation path.

In such a tandem color image forming apparatus, the four photoreceptor drums for cyan, magenta, yellow and black image formation are disposed in parallel as extending perpendicularly to a sheet transportation direction. The monochromatic toner images of the respective colors are formed on surfaces of the respective photoreceptor drums. In the course of transportation of a sheet along the sheet transportation path, the monochromatic toner images formed on the respective photoreceptor drums are successively transferred onto the sheet. After the transfer of the fourth color toner image, the toner images on the sheet are subjected to a fixation process, whereby a full color image is recorded on the sheet.

Since the tandem image forming apparatus is constructed so that four toner images are successively transferred in superimposition on a sheet, there is a possibility of misregistration of the respective color toner images, which will show up as a color offset in the resulting image.

SUMMARY OF THE INVENTION

It is an object of the present invention to provide an image forming apparatus which is less liable to cause a color offset in an image formed on a sheet.

The image forming apparatus of the present invention comprises: a plurality of photoreceptors provided along a sheet transportation path and each extending perpendicularly to the sheet transportation path; an imaging mechanism for forming toner images on surfaces of the respective photoreceptors; and a pair of support plates which receive opposite end circumferential portions of the respective photoreceptors to support the photoreceptors together in a parallel relation.

The sheet transportation path may be a linear transportation path.

The imaging mechanism may be adapted to form different color toner images on the respective photoreceptors. The pair of support plates may support the plurality of photoreceptors in a rotatable manner.

The photoreceptors may be of a drum shape.

With this arrangement, the plurality of photoreceptors are supported with their opposite end circumferential portions received by the pair of support plates and, hence, there is no likelihood of a color offset which may otherwise occur due to wobbling of the photoreceptors during the driving thereof.

In a conventional arrangement in which photoreceptors each have a drum shaft extending therethrough and opposite ends of the drum shaft are supported by bearings, the photoreceptors may wobble due to off-centering of the drum shaft during the driving thereof if the rotation center of the photoreceptor does not exactly coincide with the drum shaft.

On the contrary, the aforesaid arrangement is such that the photoreceptors have no drum shaft and the circumferential portions of the photoreceptors are supported and, therefore, the photoreceptors never suffer from wobbling which may otherwise occur due to the off-centering of the drum shafts. Hence, there is no danger that the respective color toner images are misregistered on the sheet to cause a color offset in the resulting image. Thus, formation of a high quality image can be ensured.

It is preferred that bearings are fitted around the opposite end circumferential portions of the respective photoreceptors, and the pair of support plates each have the same number of cut-away portions as the number of the photoreceptors, the cut-away portions being formed in a spaced apart relation for receiving outer rings of the bearings.

The cut-away portions are preferably formed equidistantly.

Further, the pair of support plates are preferably conformal members which are formed by stamping flat plates by means of the same stamping die.

With this arrangement, the pair of support plates are formed with the use of the same stamping die and, hence, the cut-away portions formed in one of the support plates are arranged at the same interval as the cut-away portions formed in the other support plate. Since the plurality of photoreceptors supported by the pair of support plates are arranged parallel to each other, there is no possibility that any one of the photoreceptors is disposed at angles with respect to the other photoreceptors to cause misregistration of the respective color toner images on the sheet. In addition, the parallel arrangement of the photoreceptors can be achieved simply by supporting the photoreceptors on the pair of support plates. Accordingly, there is no need for adjustment of the parallelism of the photoreceptors.

The image forming apparatus may further includes a squareness adjustment mechanism for properly positioning one of the pair of support plates with respect to the other support plate along the sheet transportation path, so that the plurality of photoreceptors are each disposed perpendicularly to the sheet transportation path.

With this arrangement, the position of the one support plate with respect to the other support plate along the sheet transportation path can easily be adjusted by means of the squareness adjustment mechanism and, therefore, the plurality of photoreceptors supported by the pair of support plates can each easily be disposed perpendicularly to the sheet transportation direction. Thus, the plurality of photoreceptors can be prevented from being arranged in parallel on the skew with respect to a direction perpendicular to the sheet transportation direction. Therefore, the image is prevented from being formed on the skew with respect to an edge of the sheet, so that the quality of the image can further be improved.

The imaging mechanism may include the bearings fitted around the opposite end circumferential portions of the photoreceptors, a frame including the pair of support plates and detachably supporting image forming sections including the photoreceptors, a pair of fixture plates supporting the bearings attached to the opposite end portions of each of the photoreceptors, engagement portions respectively projecting from the pair of fixture plates outwardly of the frame, and a fixture mechanism fixing the pair of fixture plates to the frame in engagement with the engagement portions. In this case, the cut-away portions which receive the outer rings of the bearings are provided in upper edge portions of the support plates.

With this arrangement, the bearings fitted around the opposite end portions of the photoreceptors are fixed to the pair of fixture plates, and then the engagement portions provided on the pair of fixture plates are brought into engagement with the fixture mechanism, whereby the photoreceptors each supported on the pair of fixture plates can be fixed to the frame. More specifically, the attachment and detachment of the photoreceptors to the frame can be achieved by such a simple action that the fixture mechanism is brought into and out of engagement with the engagement portions provided on the pair of fixture plates. This remarkably facilitates the assembly of an imaging unit.

Further, the positioning of the photoreceptors can readily be achieved by fitting the bearings fitted around the opposite end circumferential portions of the photoreceptors in the cut-away portions of the pair of support plates.

Where the present invention is applied to a color image forming apparatus of tandem type, replacement of the image forming sections can easily be achieved. Since the respective image forming sections can be kept in a consistent positional relationship, a color offset in an image formed on a sheet can be prevented.

The fixture mechanism may include slide plates attached to the frame slidably along the length of the support plates, engagement members which are to be brought into and out of engagement with the engagement portions by sliding the slide plates, and biasing mechanisms resiliently biasing the engagement members to the engagement portions. In this case, the pair of fixture plates are preferably adapted to be fixed to the frame by bringing the engagement members into engagement with the engagement portions with predetermined portions of the pair of fixture plates respectively abutting against the pair of support plates.

The image forming sections may each include a developer unit for developing an electrostatic latent image formed on a photoreceptor surface into a toner image, and a cleaning unit for recovering residual toner from the photoreceptor surface after the toner image is transferred from the photoreceptor surface onto the sheet. In this case, it is preferred that the developer unit and the cleaning unit are attached to the pair of fixture plates which are in turn fixed to the frame whereby the developer unit and the cleaning unit are fixed to the frame.

With this arrangement, the image forming sections each including the photoreceptor, the developer unit and the cleaning unit is fixed to the frame by attaching the image forming sections to the pair of fixture plates and then fixing the fixture plates to the frame. This allows for easy attachment and detachment of the image forming sections to the frame, thereby further facilitating the assembly of the imaging unit.

It is preferred that the plurality of image forming sections are supported together by the frame. With this arrangement, the positioning of the respective photoreceptors with respect to the frame can easily be achieved by fitting the bearings in the cut-away portions, so that the respective photoreceptors can be kept in a consistent positional relationship. Hence, there is no likelihood of a color offset which may otherwise occur due to inappropriate positioning of the photoreceptors.

The image forming apparatus may further include a slide mechanism removably supporting the frame with respect to a main body of the image forming apparatus, and a positioning pin to be inserted in a positioning hole formed in a predetermined position of the frame with the frame being installed within the main body. In this case, the fixture mechanism preferably includes a member to be located in such a position that the positioning pin is prevented from being inserted into the positioning hole when the pair of fixture plates are not fixed to the frame. This member may be, for example, a portion (e.g., one end portion) of the slide plate.

With this arrangement, where the pair of fixture plates are not fixed to the frame, i.e., where the fixture mechanism is out of engagement with the engagement portions provided on the pair of fixture plates, the positioning pin is prevented from being inserted into the positioning hole formed in the frame. Therefore, where the image forming sections including the photoreceptors are not fixed to the frame, the frame cannot be installed in the main body of the apparatus.

Thus, the imaging unit is prevented from being installed in the main body of the apparatus, where the imaging sections including the photoreceptors and the developer units are not appropriately mounted on the frame. This eliminates the possibility of an image formation failure which may otherwise occur due to inappropriate mounting of the image forming sections on the frame.

The image forming apparatus may further include a transportation mechanism for transporting toward the imaging mechanism a sheet on which an image is to be formed, and a transfer mechanism for transferring the toner images formed by the imaging mechanism onto the sheet transported by the transportation mechanism.

This arrangement allows for easy assembly of the imaging unit, thereby facilitating the assembly of the image forming apparatus.

The foregoing and other objects, features and effects of the present invention will become more apparent from the following description of the preferred embodiments with reference to the attached drawings.

DESCRIPTION OF THE PREFERRED EMBODIMENTS

Figure 1:
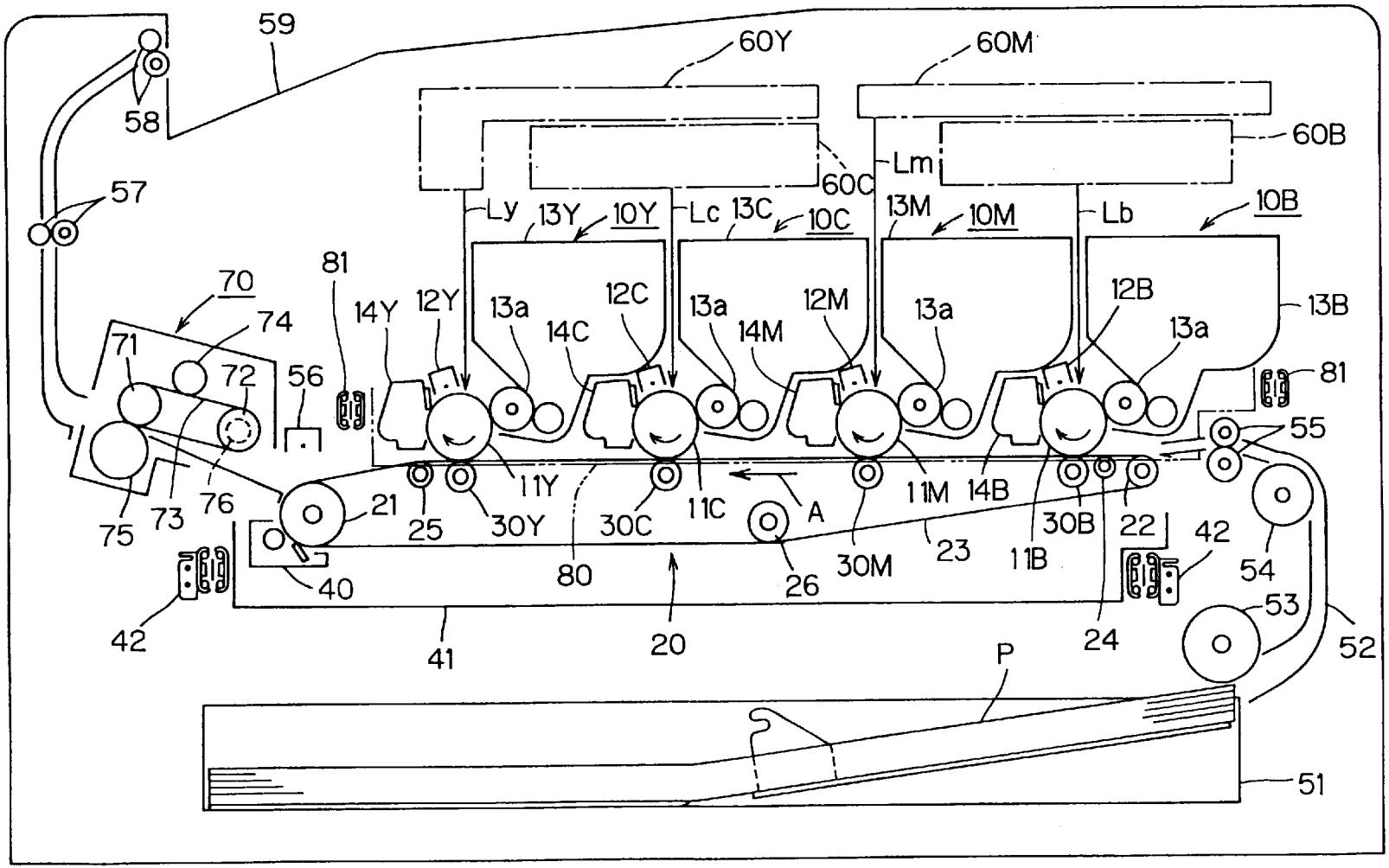
FIG. 1 is a sectional view illustrating the internal construction of a full color printer according to one embodiment of the present invention.

FIG. 1 is a sectional view illustrating the internal construction of a full color printer according to one embodiment of the present invention. The full color printer has a so-called tandem structure. In the printer, more specifically, four image forming sections 10B, 10M, 10C and 10Y for forming black, magenta, cyan and yellow monochromatic images, respectively, are arranged in this order from the upstream side with respect to a sheet transportation direction along a linear transportation path defined by a sheet transportation mechanism 20 for transporting a sheet P.

The image forming sections 10B, 10M, 10C and 10Y respectively have cylindrical photoreceptors 11B, 11M, 11C and 11Y, which are arranged parallel to each other with their axes extending horizontally and perpendicularly to the sheet transportation direction. The image forming sections 10B, 10M, 10C and 10Y are respectively adapted to form black, magenta, cyan and yellow monochromatic toner images on surfaces of the photoreceptors 11B, 11M, 11C and 11Y. These toner images are each led to a position opposing to the sheet transportation mechanism 20 by the rotation of the photoreceptors about the axes thereof. The black, magenta, cyan and yellow toner images are successively transferred in superimposition onto a surface of the sheet P in the course of the transportation of the sheet P by the sheet transportation mechanism 20.

The image forming sections 10B, 10M, 10C, 10Y are integrally supported together by an imaging frame 80 to constitute an imaging unit. Slide mechanisms 81 which are comprised of ACCURIDE rails, for example, are provided on opposite sides of the imaging frame 80 as shown in the right- and left-hand parts of FIG. 1. The slide mechanisms 81 allow the imaging frame 80 to be slid back and forth with respect to a main body of the printer (perpendicularly to the paper face of FIG. 1).

The sheet transportation mechanism 20 includes a driving roller 21 disposed downstream of the image forming section 10Y located on the most downstream side with respect to the sheet transportation direction, a driven roller 22 disposed upstream of the image forming section 10B located on the most upstream side with respect to the sheet transportation direction, an endless transportation belt 23 entrained around the driving roller 21 and the driven roller 22, and assist rollers 24, 25, 26 for removing slack of the transportation belt 23 by applying a tension thereto.

With this arrangement, the transportation belt 23 travels counterclockwise as seen in FIG. 1 when a driving force is inputted to the driving roller 21 from a motor not shown to rotatively drive the driving roller 21. A sheet P on which the toner images are to be transferred is carried on an upper surface of the transportation belt 23 and transported linearly in the direction of an arrow A by the traveling of the transportation belt 23.

A black image transfer roller 30B, a magenta image transfer roller 30M, a cyan image transfer roller 30C and a yellow image transfer roller 30Y are respectively disposed below the photoreceptors 11B, 11M, 11C and 11Y as being opposed thereto across an upper portion of the transportation belt 23. These transfer rollers 30B, 30M, 30C, 30Y serve to press the transportation belt 23 against the photoreceptors 11B, 11M, 11C, 11Y from the lower side thereof, and also to transfer the toner images from the photoreceptors 11B, 11M, 11C, 11Y onto the sheet.

A belt cleaner 40 for removing dirt such as toner and paper dust adhering to a surface of the transfer belt 23 is provided below the driving roller 21. The sheet transportation mechanism 20, the transfer rollers 30B, 30M, 30C, 30Y and the belt cleaner 40 are integrally supported together by a unit case 41, and are movable back and forth with respect to the printer main body by means of slide mechanisms 42 provided on opposite sides of the unit case 41 as shown in the right- and left-hand parts of FIG. 1.

A sheet tray 51 for accommodating a stack of sheets P is provided below the unit case 41. A sheet feeding roller 53 for feeding the sheets P one by one from the sheet tray 51 to a transportation path 52 is provided in association with the sheet tray 51. A sheet P having fed out into the transportation path 52 by rotation of the sheet feeding roller 53 is transported toward a registration roller pair 55 by a transportation roller 54. The registration roller pair 55 is disposed upstream of the sheet transportation mechanism 20 with respect to the sheet transportation direction. The registration roller pair 55 once stops the transported sheet P, and then feeds out the sheet P onto the transportation belt 23 in timed relation to a toner image forming operation performed by the image forming section 10B.

A black image laser scanning section 60B, a magenta image laser scanning section 60M, a cyan image laser scanning section 60C and a yellow image laser scanning section 60Y for irradiating the photoreceptors 11B, 11M, 11C and 11Y, respectively, with laser beams are provided above the image forming sections 10B, 10M, 10C and 10Y. The printer is connected, for example, to an external device such as a personal computer (not shown). Image data inputted from the external device is resolved into color image data for black, magenta, cyan and yellow components, which are in turn applied to the corresponding color laser scanning sections 60B, 60M, 60C and 60Y.

The laser scanning sections 60B, 60M, 60C, 60Y each include a laser source, a polygon mirror, a reflector mirror and the like (not shown). When color image data indicative of black, magenta, cyan and yellow image densities are inputted to the laser scanning sections 60B, 60M, 60C, 60Y, laser beams Lb, Lm, Lc and Ly modulated on the basis of the color image data are directed to the image forming sections 10B, 10M, 10C and 10Y, respectively.

The photoreceptor 11B provided in the black image forming section 10B is rotated in an arrow direction (clockwise in FIG. 1) at a constant speed during the image forming operation. A main charger 12B, a developer unit 13B and a cleaner 14B are provided around the photoreceptor 11B in this order in the rotation direction thereof. The laser beam incident from the black image laser scanning section 60B is directed onto the surface of the photoreceptor 11B between the main charger 12B and the developer unit 13B.

The surface of the photoreceptor 11B, after being uniformly charged by discharge of the main charger 12B, is exposed to the laser beam incident from the black image laser scanning section 60B. Thus, a so-called electrostatic latent image is formed on the surface of the photoreceptor 11B. The electrostatic latent image formed on the surface of the photoreceptor 11B is developed into a toner image with a black toner by means of the black image developer unit 13B. When the photoreceptor 11B is further rotated, the black toner image formed on the photoreceptor 11B is conveyed to be opposed to the sheet transportation mechanism 20.

In synchronization with the opposition of the toner image to the sheet transportation mechanism 20, the registration roller pair 55 is rotatively driven, and a sheet P is transported by the transportation belt 23. A predetermined transfer voltage is applied to the black image transfer roller 30B which is provided below the photoreceptor 11B as being opposed to the photoreceptor 11B across the upper portion of the transportation belt 23. Thus, the black toner on the surface of the photoreceptor 11B is attracted to the black image transfer roller 30B so as to be transferred onto the sheet P. Residual toner particles on the surface of the photoreceptor 11B are recovered by the cleaner 14B after the transfer of the toner image.

The sheet P having the black toner image thus transferred thereon is transported toward the image forming sections 10M, 10C, 10Y by means of the transportation belt 23. The image forming sections 10M, 10C and 10Y have substantially the same construction as the aforesaid black image forming section 10B, i.e., respectively have main chargers 12M, 12C and 12Y, developer units 13M, 13C and 13Y, and cleaners 14M, 14C and 14Y, which are disposed around the photoreceptors 11M, 11C and 11Y, respectively. In the image forming sections 10M, 10C and 10Y, magenta, cyan and yellow monochromatic toner images are formed on the photoreceptors 11M, 11C and 11Y, respectively, and successively transferred in superimposition on the sheet P in timed relation to the transportation of the sheet P.

The sheet P having the respective color toner images thus transferred thereon in superimposition is subjected to discharge of a separation charger 56 thereby to be separated from the transportation belt 23 with a reduced adhesion to the transportation belt 23, and then introduced into a fixation unit 70. The fixation unit 70 includes a thermal fixation belt 73 entrained around a pair of rollers 71, 72, an oil roller 74 for supplying an oil to the thermal fixation belt 73 for prevention of toner sticking onto the thermal fixation belt 73, a pressure roller 75 provided below the roller 71, and a heater 76 provided inside the roller 72.

The thermal fixation belt 73 is pressed with a proper pressure against the pressure roller 75 adjacent its downstream end with respect to the sheet transportation direction, and extends toward the upstream side from the downstream end. The sheet P transported toward the fixation unit 70 is preheated by the thermal fixation belt 73 before reaching a nip position between the thermal fixation belt 73 and the pressure roller 75, and the respective color toners on the sheet P are fixed thereon by heat and pressure by means of the thermal fixation belt 73 and the pressure roller 75. The sheet P having subjected to the fixation process is outputted onto a sheet output portion 59 provided on a top face of the printer main body by means of the sheet output rollers 57, 58.

The process sequence described above is one cycle of the image forming operation for formation of a full color image on a sheet P.

Figure 2:
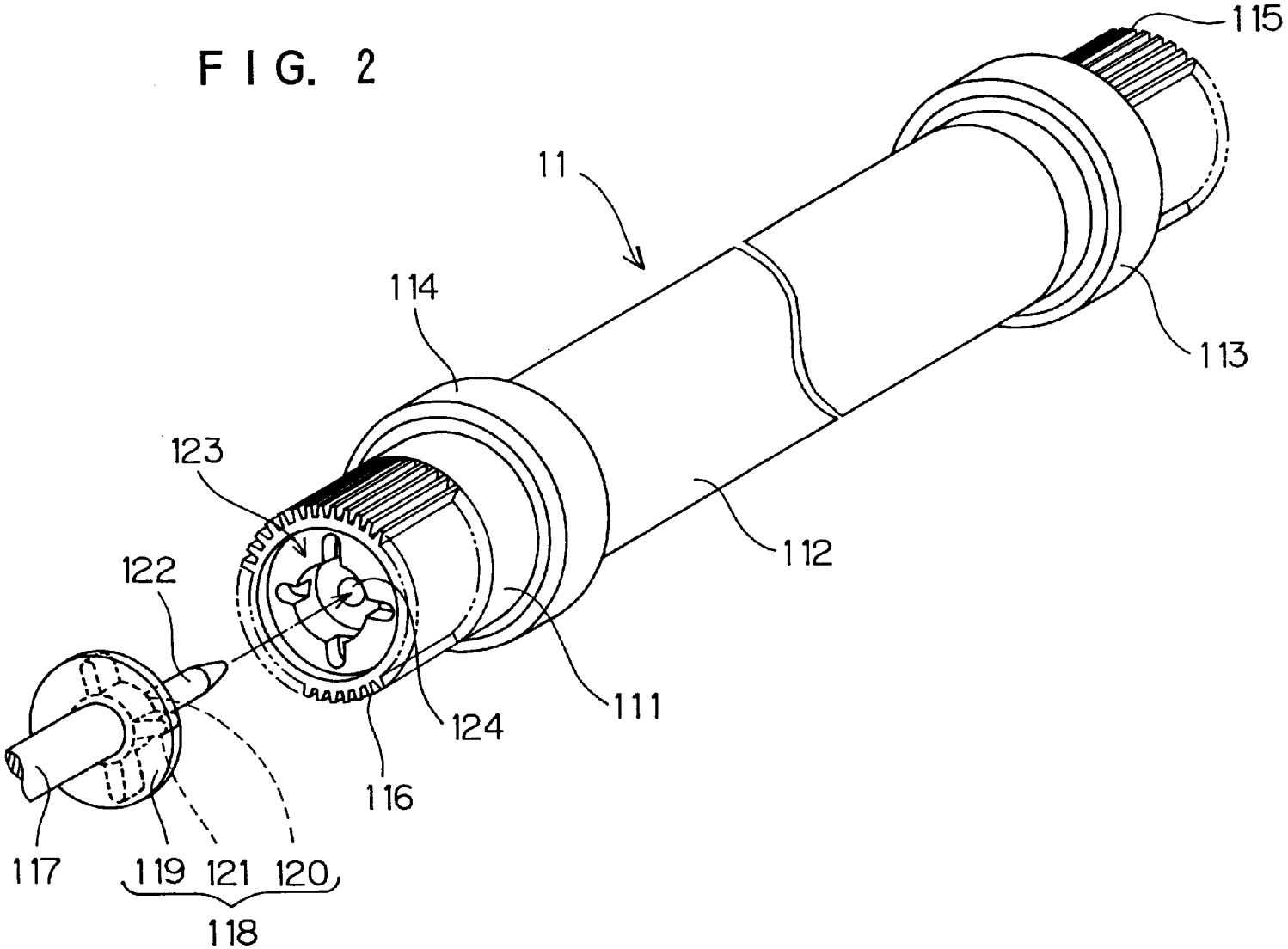
FIG. 2 is an exploded perspective view illustrating the construction of a photoreceptor as seen from the innermost side of a main body of the printer.

FIG. 2 is an exploded perspective view illustrating the construction of the photoreceptor 11B, 11M, 11C, 11Y as seen from the innermost side of the printer main body. The photoreceptors 11B, 11M, 11C, 11Y have substantially the same construction and, therefore, are hereinafter referred to generally as "photoreceptor 11".

The photoreceptor 11 comprises a cylindrical bare pipe 111 such as of aluminum and a photosensitive layer 112 of a predetermined width formed on the circumferential surface of the pipe. Bearings 113, 114 are fitted around bare pipe portions of the photoreceptor 11 provided on opposite sides of the photosensitive layer 112 thereof. Drum gears 115, 116 to be meshed with developer roller gears (not shown) provided at opposite ends of a rotation shaft of a developer roller 13*a* (see FIG. 1) are press-fitted in opposite open ends of the cylindrical bare pipe 111. The cylindrical bare pipe 111 is fixed to inner rings of the bearings 113, 114 by press-fitting the drum gears 115, 116 into the cylindrical bare pipe 111.

A driving force from a drum motor not shown is inputted via a driving force transmission shaft 117 to the drum gear 116 located in the left-hand part of FIG. 2 (on the innermost side of the printer main body when installed therein).

More specifically, a transmission member 118 for transmitting a rotational motion of the driving force transmission shaft 117 to the drum gear 116 is provided at a distal end of the driving force transmission shaft 117. The transmission member 118 has a flange 119 outwardly projecting from the driving force transmission shaft 117, a cylindrical portion 120 provided between the flange 119 and the distal end of the driving force transmission shaft 117, and four engagement portions 121 radially extending from a circumferential surface of the cylindrical portion 120 on a surface of the flange 119. An insertion shaft 122 projects from the center of the cylindrical portion 120 along the driving force transmission shaft 117.

An engagement recess 123 conformal to the exterior shape of the transmission member 118 is provided in an end face of the drum gear 116. Further, an insertion hole 124 having substantially the same diameter as the insertion shaft 122 is formed in a central portion of the engagement recess 123.

The driving force transmission shaft 117 is connected to the drum gear 116 by inserting the insertion shaft 122 into the insertion hole 124 and fitting the transmission member 118 in the engagement recess 123. In this state, the transmission member 118 is engaged with the engagement recess 123 which is conformal to the exterior shape of the transmission member 118, so that relative rotation between the drum gear 116 and the transmission member 118 does not occur. Therefore, when the driving force transmission shaft 117 is rotated by the driving force applied from the drum motor, the rotational motion of the driving force transmission shaft 117 is transmitted to the drum gear 116 via the transmission member 118, thereby rotating the photoreceptor 111. The rotational motion of the photoreceptor 11 is transmitted to the developer roller gears (not shown) from the drum gears 115, 116 provided on opposite ends of the photoreceptor 11, whereby the developer roller 13*a* is rotated in a direction opposite to the rotational direction of the photoreceptor 11.

Figure 3:
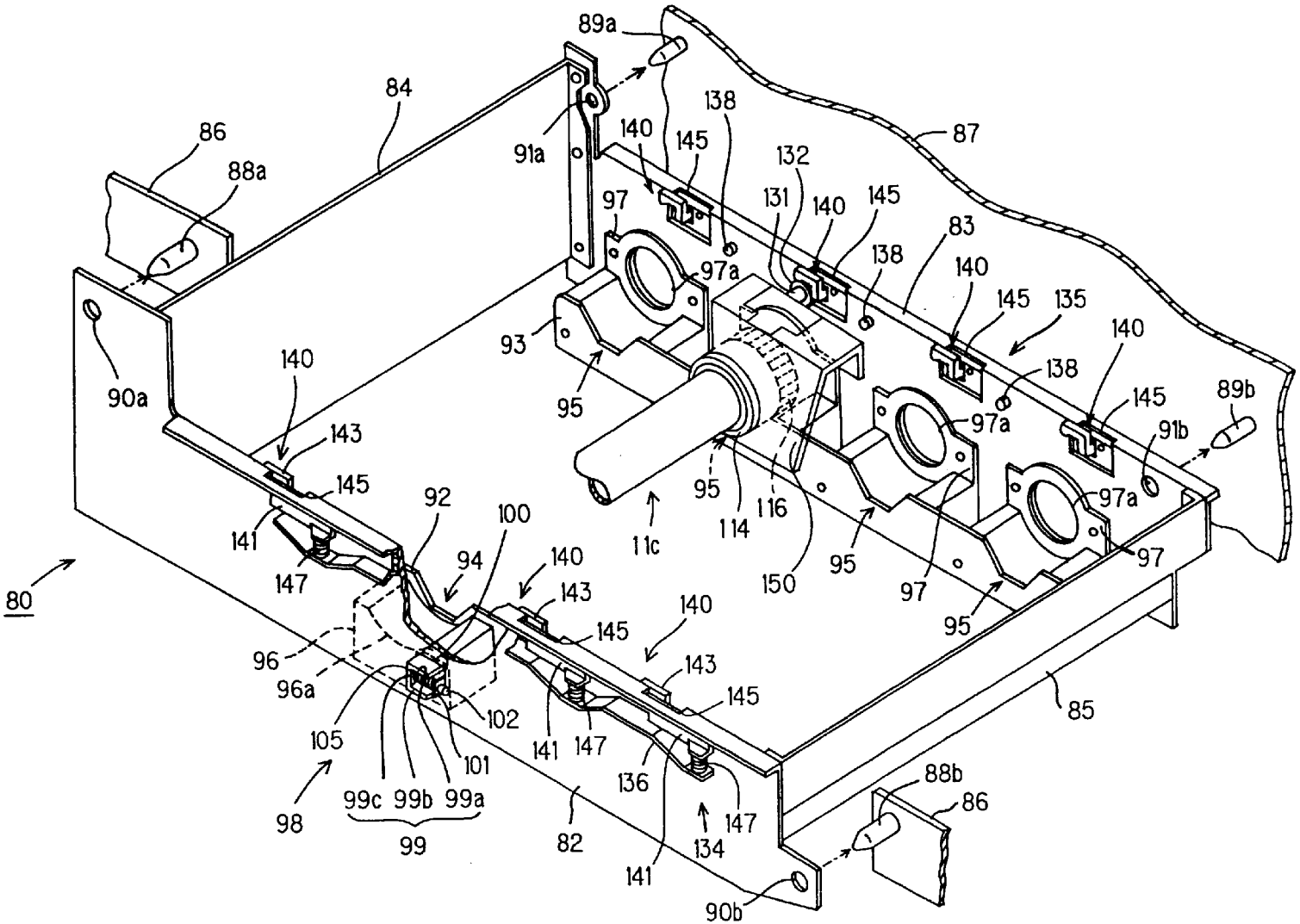
FIG. 3 is a perspective view illustrating the construction of an imaging frame for supporting image forming sections together.
Figure 4:
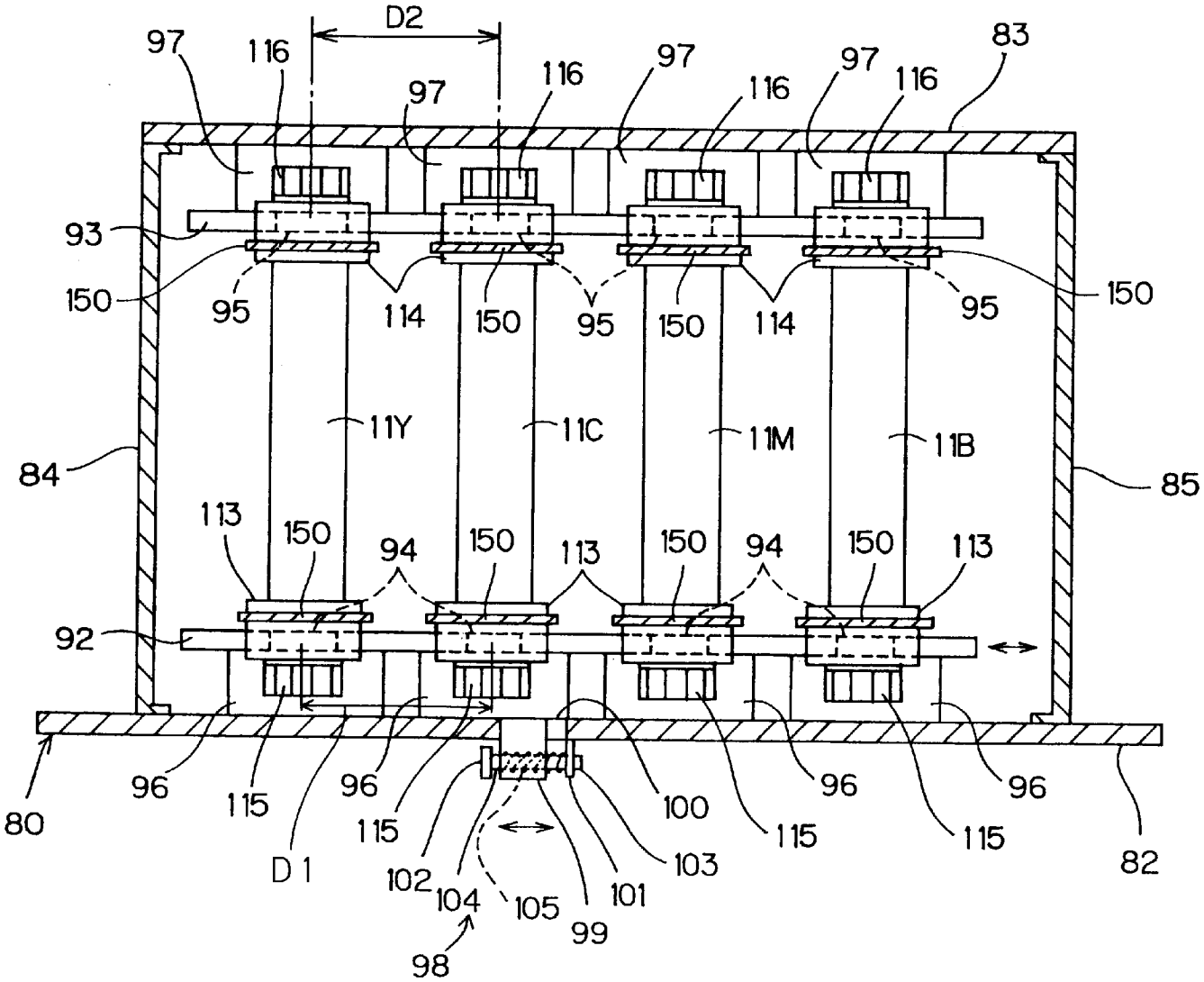
FIG. 4 is a schematic sectional view of the imaging frame taken along a horizontal plane.

FIG. 3 is a perspective view illustrating the construction of the imaging frame 80 for integrally supporting the image forming sections 10B, 10M, 10C, 10Y together. FIG. 4 is a schematic sectional view of the imaging frame 80 taken along a horizontal plane.

The imaging frame 80 has a unit front face plate 82 and a unit rear face plate 83 which extend in the sheet transportation direction, and connection plates 84, 85 connecting longitudinally opposite ends of the unit front face plate 82 to longitudinally opposite ends of the unit rear face plate 83. The unit front face plate 82 and the unit rear face plate 83 are spaced a predetermined distance from each other perpendicularly to the sheet transportation direction in a parallel relation.

The connection plates 84, 85 are respectively provided with the slide mechanisms 81 (see FIG. 1), so that the imaging frame 80 is slidable back and forth with respect to the main body. A front restriction plate 86 and a rear restriction plate 87 for restriction of the inward slide movement of the imaging frame 80 are provided within the printer main body. The front restriction plate 86 and the rear restriction plate 87 are respectively provided with two positioning pins 88*a*, 88*b* and two positioning pins 89*a*, 89*b* which project forwardly of the corresponding plates 86, 87. Positioning holes 90*a*, 90*b* which receive the positioning pins 88*a*, 88*b* provided on the front restriction plate 86 when the imaging frame 80 is installed in the printer main body are formed in longitudinally opposite end portions of the unit front face plate 82. Further, positioning holes 91*a*, 91*b* which receive the two positioning pins 89*a*, 89*b* provided on the rear restriction plate 87 when the imaging frame 80 is installed in the printer main body are formed in longitudinally opposite end portions of the unit rear face plate 83.

The positioning pins 88*a*, 88*b* of the front restriction plate 86 are inserted into the positioning holes 90*a*, 90*b* of the unit front face plate 82, while the positioning pins 89*a*, 89*b* of the rear restriction plate 87 are inserted into the positioning holes 91*a*, 91*b* of the unit rear face plate 83. Thus, the imaging frame 80 is properly positioned with respect to the printer main body.

Support plates 92, 93 for supporting the four photoreceptors 11B, 11M, 11C, 11Y are provided on the rear side of the unit front face plate 82 and on the front side of the unit rear face plate 83, respectively, as extending parallel to the unit front face plate 82 and the unit rear face plate 83. The support plates 92, 93 are conformal members which are formed, for example, by stamping flat metal plates with the same stamping die. The support plates 92, 93 each have four generally V-shaped cut-away portions 94, 95 equidistantly formed in an upper edge portion thereof. The four photoreceptors 11B, 11M, 11C, 11Y are each supported by the imaging frame 80 in such a state that the bearings 113, 114 fitted around the opposite end portions are held by a pair of fixture plates 150 and portions of the bearings 113, 114 located outside the fixture plates 150 are held by the V-shaped cut-away portion 94 of the support plate 92 and the V-shaped cut-away portion 95 of the support plate 93.

Four fixture blocks 96 of a synthetic resin are respectively disposed in association with the four V-shaped cut-away portions 94 and fixed to a surface of the support plate 92 opposed to the unit front face plate 82. Similarly, four fixture blocks 97 of a synthetic resin are respectively disposed in association with the four V-shaped cut-away portions 95 and fixed to a surface of the support plate 93 opposed to the unit rear face plate 83. The support plates 92 and 93 are respectively fixed to the unit front face plate 82 and to the unit rear face plate 83 via the fixture blocks 96 and 97. Round holes 97*a* are formed in the unit rear face plate 83 and the fixture blocks 97 fixed to the support plate 93 as extending therethrough. The driving force transmission shaft 117 described with reference to FIG. 2 is inserted from the rear side of the unit rear face plate 83 through the hole 97*a* so as to be coupled to the drum gear 116.

In the full color printer according to this embodiment, the photoreceptors 11B, 11M, 11C, 11Y are rotatably supported via the bearings 113, 114 fitted around the opposite end portions thereof as described above and, therefore, are free from wobbling which may otherwise be caused due to rotation thereof.

In the conventional arrangement in which the photoreceptors each have a drum shaft extending therethrough and opposite ends of the drum shaft are supported by bearings, the photoreceptors may wobble due to off-centering of the drum shaft during driving thereof if the rotation center of the photoreceptor does not exactly coincide with the drum shaft. On the contrary, this embodiment in which the photoreceptors 11B, 11M, 11C, 11Y have no drum shaft but are supported directly by the bearings 113, 114 never suffer from wobbling which may otherwise occur due to the off-centering of the drum shafts. Therefore, there is no likelihood that the respective color toner images are misregistered on the sheet due to the wobbling of the photoreceptors 11B, 11M, 11C, 11Y.

Further, the support plates 92, 93 respectively supporting the outer rings of the bearings 113, 114 are formed with the use of the same stamping die and, therefore, the interval D1 (see FIG. 4) at which the V-shaped cut-away portions 94 are formed in the support plate 92 is equal to the interval D2 (see FIG. 4) at which the V-shaped cut-away portions 95 are formed in the support plate 93. Since the four photoreceptors 11B, 11M, 11C, 11Y supported by the support plates 92, 93 are arranged parallel to each other, there is no possibility of misregistration of the respective color toner images on the sheet which may occur when any one of the photoreceptors is disposed at angles with respect to the other photoreceptors. Further, there is no need for adjustment of the parallelism of the photoreceptors 11B, 11M, 11C, 11Y, because the parallel arrangement of the photoreceptors 11B, 11M, 11C, 11Y can be achieved simply by supporting the photoreceptors on the pair of support plates 92, 93.

However, the four photoreceptors 11B, 11M, 11C, 11Y may be arranged in parallel on the skew with respect to a direction perpendicular to the sheet transportation direction, unless the V-shaped cut-away portions 94 of the support plate 92 are exactly opposed to the V-shaped cut-away portions 95 of the support plate 93 perpendicularly to the sheet transportation direction. In such a case, the misregistration of the respective color toner images on the sheet does not occur, but the image may be formed on the sheet on the skew with respect to an edge of the sheet. For this reason, the full color printer according to this embodiment includes a squareness adjustment mechanism 98 for adjusting the position (lateral positional relation as seen in FIG. 4) of the support plate 92 with respect to the support plate 93 along the sheet transportation direction so that the photoreceptors 11B, 11M, 11C, 11Y can be positioned perpendicularly to the sheet transportation direction.

The squareness adjustment mechanism 98 is provided in association with at least one of the four fixture blocks 96 fixed to the surface of the support plate 92. In this embodiment, the squareness adjustment mechanism 98 is provided in association with the fixture block 96 fixed to the support plate 92 in front of the V-shaped cut-away portion 94 which supports the cyan image photoreceptor 11C.

The fixture blocks 96 each have such a configuration that a curved indentation 96*a* having a generally semicircular cross section is formed on a top surface of a rectangular solid block. The squareness adjustment mechanism 98 includes a projection 99 projecting from a surface of the fixture block 96 which is in intimate contact with the unit front face plate 82. The projection 99 has an open-ended square cross section which opens toward the upstream side with respect to the sheet transportation direction, and has horizontal portions 99*a*, 99*b* vertically spaced a predetermined distance and a vertical portion 99*c* connecting the horizontal portions 99*a* and 99*b*. The projection 99 projects through a rectangular opening 100 formed in the unit front face plate 82 toward the front side of the unit front face plate 82.

The rectangular opening 100 of the unit front face plate 82 has a slightly greater width than the projection 99 as measured in the sheet transportation direction. A fixture piece 101 projects along a vertical plane perpendicular to the unit front face plate 82 toward the front side thereof from an upstream edge of the rectangular opening 100 with respect to the sheet transportation direction.

The fixture piece 101 is formed with a bolt hole 103 which is threadingly engaged with a bolt 102 for connecting the projection 99 to the fixture piece 101. The vertical portion 99*c* of the projection 99 is formed with an insertion hole 104 into which the bolt 102 is inserted. The bolt 102 is inserted into the insertion hole 104 from the left side of the projection 99, and a distal portion thereof is threadingly engaged with the bolt hole 103, whereby the projection 99 and the fixture piece 101 are coupled to each other. Further, a spring 105 is fitted around the bolt 102 between the vertical portion 99*c* of the projection 99 and the fixture piece 101, so that the projection 99 is biased away from the fixture piece 101 by the spring 105.

With this arrangement, the projection 99 is coupled to the fixture piece 101 by the bolt 102 and biased by the spring 105, whereby the support plate 92 fixed to the four fixture blocks 96 is fixed to the unit front face plate 82. Rotation of the bolt 102 in a tightening direction moves the projection 99 toward the fixture piece 101 against a resilient force of the spring 105. Thus, the support plate 92 fixed to the fixture blocks 96 slides upstream in the sheet transportation direction. Rotation of the bolt 102 in a loosening direction moves the projection 99 away from the fixture piece 101 by the resilient force of the spring 105, whereby the support plate 92 fixed to the fixture blocks 96 slides downstream in the sheet transportation direction.

On the other hand, the support plate 93 is fixed to the unit rear face plate 83 by fastening the fixture blocks 97 fixed on one surface of the support plate 93 to the unit rear face plate 83 by screws. Therefore, the position of the support plate 92 with respect to the support plate 93 along the sheet transportation direction can be adjusted by rotating the bolt 102 either in the tightening direction or in the loosening direction to slide the support plate 92 in the sheet transportation direction. Thus, the four photoreceptors 11B, 11M, 11C, 11Y supported by the support plates 92, 93 can be positioned parallel to each other and perpendicularly to the sheet transportation direction.

Figure 5:
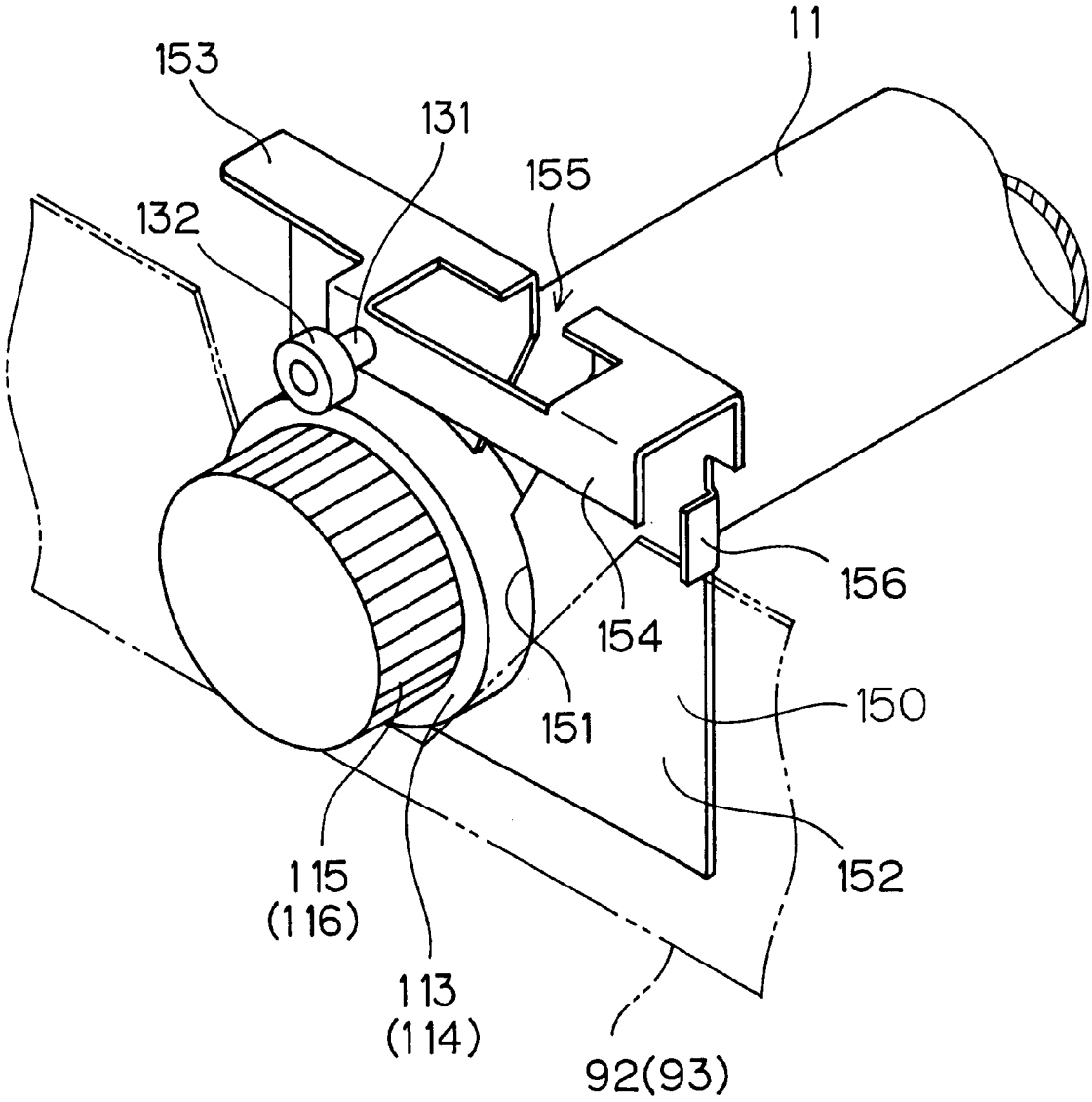
FIG. 5 is a perspective view illustrating the construction of a fixture plate.

FIG. 5 is a perspective view illustrating the construction of the fixture plate 150. The pair of fixture plates 150 are provided for each of the image forming sections 10B, 10M, 10C, 10Y. The photoreceptor 11B, 11M, 11C, 11Y, the main charger 12B, 12M, 12C, 12Y, the developer unit 13B, 13M, 13C, 13Y, and the cleaner 14B, 14M, 14C, 14Y are integrally supported together by the pair of fixture plates 150.

More specifically, the fixture plates 150 each have a main portion 152 formed with an opening 151 in which the bearing 113 (114) is fitted, an extension portion 153 horizontally extending from an upper edge of the main portion 152 toward an end of the photoreceptor 11, and a vertical portion 154 vertically downwardly extending from a distal edge of the extension portion 153.

The main portion 152 has a guide portion 155 incised as extending vertically downward from the upper edge thereof and further extending diagonally to reach the opening 151 for guiding the rotation shaft of the developer roller 13*a* (see FIG. 1). The developer roller 13*a* of the developer unit 13B, 13M, 13C, 13Y has abutment rolls (not shown) provided adjacent the opposite ends of the rotation shaft thereof. Opposite end portions of the rotation shaft of the developer roller 13*a* are each inserted into the guide portion 155 from an upper portion thereof and fitted therein with the abutment roll abutting against the outer circumferential surface of the bearing 113 (114). Thus, the developer roller 13*a* is properly positioned with respect to the photoreceptor 11.

Since the bearings 113, 114 have been produced with a high level of precision because of their nature, the developer unit 13B, 13M, 13C, 13Y and the photoreceptor 11B, 11M, 11C, 11Y can be kept in a consistent positional relationship by positioning the developer unit 13B, 13M, 13C, 13Y with respect to the photoreceptor 11B, 11M, 11C, 11Y with the abutment rolls abutting against the outer rings of the bearings 113, 114. Therefore, the amount of toner to be supplied to the photoreceptor 11B, 11M, 11C, 11Y can be kept constant, so that a high quality image can be formed on a sheet.

The main portion 152 has an abutment piece 156 which is provided on a right edge thereof as seen in FIG. 5 (an upstream edge thereof with respect to the sheet transportation direction) and is brought into abutment against the upper edge of the support plate 92 (93) with the fixture plate 150 being fixed to the imaging frame 80. A support shaft 131 projects from the vertical portion 154 parallel to the photoreceptor 11 (perpendicularly to the sheet transportation direction), and has an engagement roll 132 provided as an engagement portion at a distal end of the support shaft 131.

The extension portion 153 and the vertical portion 154 are not necessarily required, and may be omitted. Where the extension portion 153 and the vertical portion 154 are not provided, the support shaft 131 may project from the main portion 152, and the engagement roll 132 may be provided at the distal end of the support shaft.

Figure 6A:
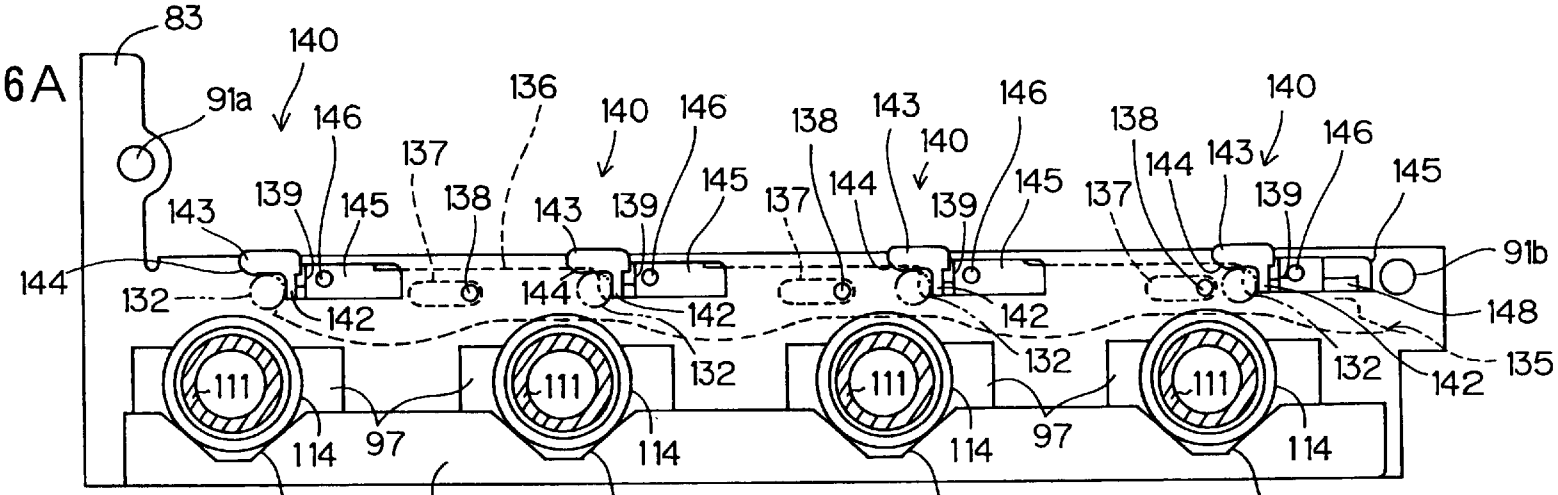
FIGS. 6A and 6B are diagrams for explaining a fixture mechanism for fixing the photoreceptor and a developer unit to the imaging frame.
Figure 6B:
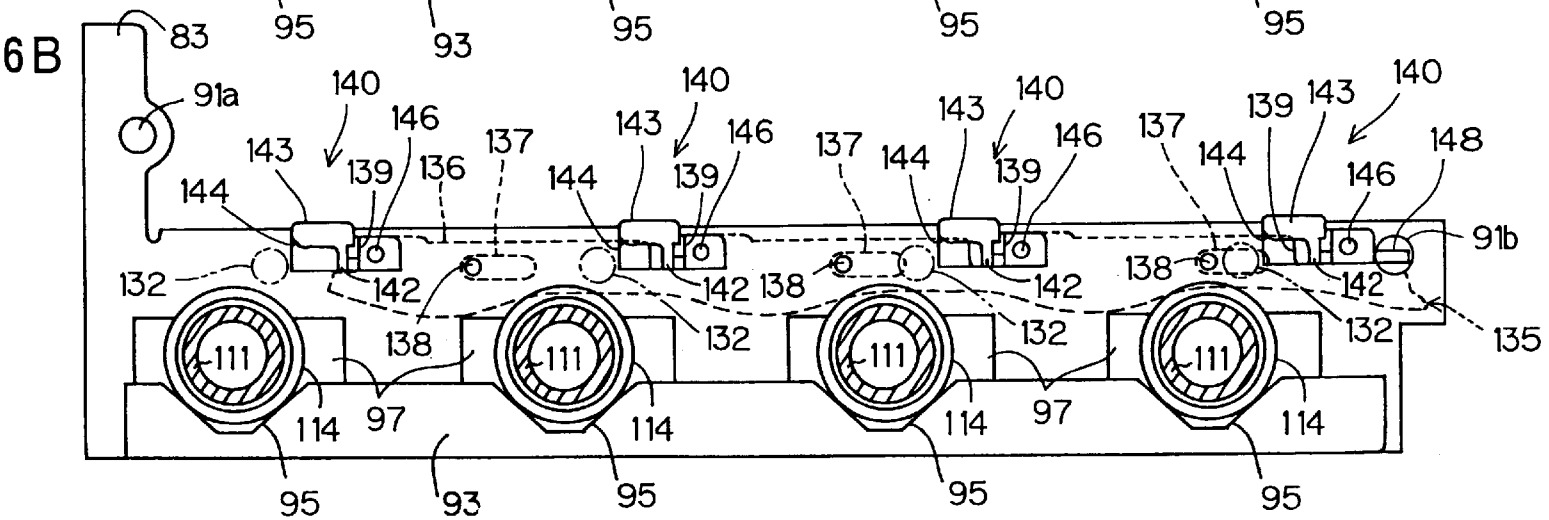

FIGS. 6A and 6B are diagrams for explaining a fixture mechanism for fixing the fixture plate 150 to the imaging frame 80. The full color printer according to this embodiment includes the fixture mechanism which is adapted to fix the pair of fixture plates 150 respectively supporting the bearings 113 and 114 to the imaging frame 80.

The fixture mechanism has a front press member 134 (see FIG. 3) attached to the unit front face plate 82, and a rear press member 135 attached to the unit rear face plate 83. The front press member 134 and the rear press member 135 are constructed symmetrically with respect to the sheet transportation direction, and each have a slide plate 136 of a generally L-shaped cross section extending in the sheet transportation direction along an outer surface of the unit front face plate 82 (unit rear face plate 83). The slide plate 136 is formed with three elongate holes 137 extending in the sheet transportation direction. The slide plate 136 is attached to the unit front face plate 82 (unit rear face plate 83) slidably in the sheet transportation direction by bolts 138 inserted in the elongate opening 137.

The slide plate 136 has four cut-away portions 139 formed at a predetermined interval from a downstream end thereof with respect to the sheet transportation direction. Four engagement members 140 are provided in association with the four cut-away portions 139. The engagement members 140 each have an elongate main portion 141 extending along the slide plate 136, a neck portion 142 extending from a downstream end of the main portion 141 with respect to the sheet transportation direction inwardly of the imaging frame 80, and a depression portion 143 projecting upward from a distal end of the neck portion 142 and then extending toward the downstream side in the sheet transportation direction. The depression portion 143 can be brought into and out of engagement with the engagement roll 132 of the fixture plate 150 by sliding the slide plate 136 with the fixture plate 150 being attached to the imaging frame 80. A projection 144 is provided on a lower surface of a distal end portion of the depression portion 143 to give a tactile click feeling upon engagement with the engagement roll 132.

On the other hand, the unit front face plate 82 and the unit rear face plate 83 each have four cut-away portions 145 formed at a predetermined interval along an upper edge thereof. The engagement members 140 are each attached to the slide plate 136 so as to be pivotally about a screw 146 within a vertical plane along the slide plate 136 with the engagement member 140 going through the cut-away portion 139 of the slide plate 136 and the cut-away portion 145 of the unit front face plate 82 or the unit rear face plate 83 so that the depression portion 143 is located within the imaging frame 80. An upstream end of the main portion 141 with respect to the sheet transportation direction is connected to a spring 147 (see FIG. 3) for upwardly biasing the upstream end. With this arrangement, the depression portion 143 of the engagement member 140 is constantly biased downward by a resilient force of the spring 147.

Referring to FIGS. 5, 6A and 6B, when the fixture plates 150 are to be fixed to the imaging frame 80, the outer rings of the bearings 113, 114 fitted around the four photoreceptors 11B, 11M, 11C, 11Y are fitted in the V-shaped cut-away portions 94 of the support plate 92 and the V-shaped cut-away portions 95 of the support plate 93, so that the four photoreceptors 11B, 11M, 11C, 11Y are supported on the support plates 92, 93. At this time, lower edges of the abutment pieces 156 provided to the main portions 152 of the fixture plates 150 are kept in abutment against the upper edges of the support plates 92, 93.

In turn, the front press member 134 and the rear press member 135 (slide plates 136) are slid upstream in the sheet transportation direction. Thus, the depression portions 143 are brought into engagement with the engagement rolls 132 of the fixture plates 150, and the engagement rolls 132 are depressed by the depression portions 143. As a result, the abutment pieces 156 of the fixture plates 150 are pressed against the upper edges of the support plates 92, 93, so that the fixture plates 150 are fixed to the imaging frame 80. Thus, the photoreceptors 11B, 11M, 11C, 11Y are properly positioned with respect to the imaging frame 80 (see FIG. 6A).

When the fixture plates 150 are to be detached from the imaging frame 80, the imaging frame 80 is withdrawn from the printer main body, and then the front press member 134 and the rear press member 135 (slide plates 136) are slid toward the upstream side in the sheet transportation direction. Thus, the depression portions 143 are disengaged from the engagement rolls 132, so that the engagement rolls 132 are released from the depression by the depression portions 143. Thus, the fixture plates 150 can be removed from the imaging frame 80.

As can be seen from FIG. 6B, with the depression portions 143 being disengaged from the engagement rolls 132, the upstream end 148 of the rear press member 135 (the main portion 141 of the most upstream engagement member 140) with respect to the sheet transportation direction overlaps with the positioning hole 91*b* of the unit rear face plate 83. Therefore, when the imaging frame 80 is slid toward the printer main body with the depression portions 143 being out of engagement with the engagement rolls 132, the positioning pin 89*b* (see FIG. 3) provided on the rear restriction plate 87 is prevented from being inserted into the positioning hole 91*b*, so that the imaging frame 80 cannot be installed in the printer main body.

In accordance with this embodiment, the photoreceptors 11B, 11M, 11C, 11Y are supported rotatably by the bearings 113, 114 fitted around the opposite end portions thereof and, therefore, the photoreceptors 11B, 11M, 11C, 11Y never wobble due to the rotation thereof unlike the case where the photoreceptors are supported via the rotation shafts thereof. Hence, there is no likelihood of misregistration of the respective color toner images on the sheet which may otherwise occur due to the wobbling of the photoreceptors 11B, 11M, 11C, 11Y.

Since the support plates 92, 93 which support the outer rings of the bearings 113, 114 have been formed with the use of the same stamping die, the four photoreceptors 11B, 11M, 11C, 11Y can be supported parallel to each other by the support plates 92, 93. Therefore, there is no likelihood of misregistration of the respective color toner images on the sheet which may occur when any one of the photoreceptors is disposed at angles with respect to the other photoreceptors.

In addition, the parallel arrangemeent of the photoreceptors 11B, 11M, 11C, 11Y can be achieved simply by supporting the photoreceptors with the pair of support plates 92, 93 and, hence, there is no need for the adjustment of the parallelism of the photoreceptors 11B, 11M, 11C, 11Y.

Since the position of the support plate 92 with respect to the support plate 93 along the sheet transportation direction can easily be adjusted by means of the squareness adjustment mechanism 98, the four photoreceptors 11B, 11M, 11C, 11Y can easily be positioned perpendicularly to the sheet transportation direction. Thus, the four photoreceptors 11B, 11M, 11C, 11Y are prevented from being arranged in parallel on the skew with respect to the direction perpendicular to the sheet transportation direction, whereby the image is prevented from being formed on the sheet on the skew with respect to an edge of the sheet.

Further, the fixture plates 150 respectively supporting the image forming sections 10B, 10M, 10C, 10Y can be fixed to the imaging frame 80 simply by sliding the front press member 134 and the rear press member 135. This remarkably facilitates the attachment and detachment of the image forming sections 10B, 10M, 10C, 10Y to the imaging frame 80 without the need for a special tool for this purpose.

Moreover, the imaging frame 80 cannot be installed in the printer main body when the fixture plates 150 are not fixed by the rear press member 135. Therefore, the imaging frame 80 is prevented from being installed in the printer main body with the image forming sections 10B, 10M, 10C, 10Y being inappropriately mounted on the imaging frame 80.

While one embodiment of the present invention has thus been described, it should be understood that the invention be not limited to the embodiment described above but may be embodied in any of various forms. For example, the invention is applied to the full color printer in the embodiment described above, but is widely applicable to any other image forming apparatuses of tandem type such as full color copying machines.

Further, the front press member and the rear press member for fixing the fixture plates to the imaging frame are independently provided in a slidable manner in the embodiment described above. However, the front press member and the rear press member may be connected to each other by stays or the like so that the front and rear press members can be slid in unison when one of the press members is slid. In this case, the attachment and detachment of the image forming sections are further facilitated with a simple operation of sliding one of the press members.

While the present invention has been described in detail by way of the embodiment thereof, it should be understood that the embodiment is merely illustrative of the technical principles of the invention but not limitative of the same. The spirit and scope of the present invention are to be limited only by the appended claims.

This application claims priority benefits under 35 USC Section 119 on the basis of Japanese Patent Application No. 10-154940 filed to the Japanese Patent Office on Jun. 3, 1998, the disclosure thereof being incorporated herein by reference.

What is claimed is:

1. An image forming apparatus, comprising:

a plurality photoreceptors provided along a sheet transportation path and each extending perpendicularly to the sheet transportation path;

an imaging mechanism for forming toner images on surfaces of the respective photoreceptors;

a pair of support plates which receive opposite end circumferential portions of the respective photoreceptors to support the photoreceptors in a parallel relation; and a frame to which the pair of support plates are attached.

2. An image forming apparatus as set forth in claim 1, wherein bearings are fitted around the opposite end circumferential portions of the respective photoreceptors, wherein the pair of support plates each have the same number of cut-away portions as the number of the photoreceptors for receiving outer rings of the bearings, the cut-away portions being formed in a spaced apart relation.

3. An image forming apparatus as set forth in claim 1, wherein the pair of support plates are conformal members which are formed by stamping flat plates with the use of a same stamping die.

4. An image forming apparatus comprising:

a plurality photoreceptors provided along a sheet transportation path and each extending perpendicularly to the sheet transportation path;

an imaging mechanism for forming toner images on surfaces of the respective photoreceptors;

a pair of support plates which receive opposite end circumferential portions of the respective photoreceptors to support the photoreceptors in a parallel relation;

a frame to which the pair of support plates are attached; and a squareness adjustment mechanism for properly positioning one of the pair of support plates with respect to the other support plate along the sheet transportation path, so that the plurality of photoreceptors are each disposed perpendicularly to the sheet transportation path.

5. An image forming apparatus as set forth in claim 1, wherein the imaging mechanism includes:

bearings fitted around opposite end circumferential portions of the photoreceptors;

a pair of fixture plates supporting the bearings attached to the opposite end portions of each of the photoreceptors;

engagement portions respectively projecting from the pair of fixture plates outwardly of the frame;

a fixture mechanism fixing the pair of fixture plates to the frame in engagement with the engagement portions;

wherein cut away portions for receiving outer rings of the bearings are provided in upper edge portions of the support plates; and the pair of support plates are disposed inside of the frame and the frame detachably supports image forming sections including the photoreceptors.

6. An image forming apparatus as set forth in claim 5, wherein the fixture mechanism includes slide plates attached to the frame slidably along the length of the support plates, engagement members which are to be brought into and out of engagement with the engagement portions by sliding the slide plates, and biasing mechanisms resiliently biasing the engagement members toward the engagement portions, wherein the pair of fixture plates are fixed to the frame by bringing the engagement members into engagement with the engagement portions with predetermined portions of the pair of fixture plates respectively abutting against the pair of support plates.

7. An image forming apparatus as set forth in claim 5, wherein the image forming sections each includes a developer unit for developing an electrostatic latent image formed on a photoreceptor surface into a toner image, and a cleaning unit for recovering residual toner from the photoreceptor surface after the toner image is transferred from the photoreceptor surface onto a sheet, wherein the developer unit and the cleaning unit are attached to the pair of fixture plates which are in turn fixed to the frame whereby the developer unit and the cleaning unit are fixed to the frame.

8. An image forming apparatus as set forth in claim 5, wherein the plurality of image forming sections are supported together by the frame.

9. An image forming apparatus as set forth in claim 5, further comprising:

a slide mechanism removably supporting the frame with respect to a main body of the apparatus; and a positioning pin to be inserted in a positioning hole formed in a predetermined position of the frame with the frame being installed within the main body;

wherein the fixture mechanism includes a member to be located in such a position that the positioning pin is prevented from being inserted into the positioning hole when the pair of fixture plates are not fixed to the frame.

10. An image forming apparatus as set forth in claim 1, further comprising:

a transportation mechanism for transporting toward the imaging mechanism a sheet on which an image is to be formed; and a transfer mechanism for transferring the toner images formed in the imaging mechanism onto the sheet transported by the transportation mechanism.

* * * * *